United States Patent [19]

Rieve

[11] 4,245,923

[45] Jan. 20, 1981

[54] PRESTRESSING AND PRESTRESSED ROAD PAVEMENTS

[76] Inventor: Johann J. Rieve, No. 21 Hallbergstrasse, 4000 Düsseldorf, Fed. Rep. of Germany

[21] Appl. No.: 942,042

[22] Filed: Sep. 13, 1978

Related U.S. Application Data

[63] Continuation of Ser. No. 792,140, Apr. 29, 1977, abandoned, which is a continuation-in-part of Ser. No. 712,469, Aug. 9, 1976, abandoned.

[30] Foreign Application Priority Data

Aug. 23, 1975 [DE] Fed. Rep. of Germany ..... 2537616

[51] Int. Cl.[2] ..... E01C 5/10

[52] U.S. Cl. ..... 404/70; 52/223 R; 264/229

[58] Field of Search ..... 404/70, 72, 17; 264/229; 52/223 R

[56] References Cited

U.S. PATENT DOCUMENTS

| | | | |
|---|---|---|---|
| 2,590,685 | 3/1952 | Coff | 404/70 |
| 2,655,846 | 10/1953 | Freyssinet | 404/70 |
| 2,833,186 | 5/1958 | Dobell | 404/70 X |
| 2,910,921 | 11/1959 | Freyssinet | 404/70 |
| 2,950,517 | 8/1960 | Brickman | 404/70 |
| 3,022,713 | 2/1962 | Friberg | 404/70 X |
| 3,066,581 | 12/1962 | Goldbeck | 404/70 |
| 3,089,215 | 5/1963 | Stubbs | 404/70 X |
| 3,156,169 | 11/1964 | Finsternalder | 404/70 |
| 3,237,537 | 3/1966 | Hutchings | 404/70 |
| 3,286,603 | 11/1966 | Finsterwalder | 404/70 |

*Primary Examiner*—Nile C. Byers, Jr.
*Attorney, Agent, or Firm*—Ernest F. Marmorek

[57] ABSTRACT

This invention provides for an apparatus and method for prestressing concrete. The apparatus includes a tendon with a tensionable peripheral member and core members that can releasably latched against the peripheral member in tension or compression. Methods are provided for constructing prestressed concrete slabs for joining the slabs to form a prestressed concrete pavement.

14 Claims, 20 Drawing Figures

PRESTRESSING AND PRESTRESSED ROAD PAVEMENTS

CROSS REFERENCES TO OTHER APPLICATIONS

This is a Continuation of my Patent Application, Ser. No. 792,140, now abandoned which is in turn a Continuation-in-Part of my Application Ser. No. 712,469, filed Aug. 9, 1976 also abandoned.

BACKGROUND OF THE INVENTION

Prestressing permits increasing the distance between pavement joints from approximately 5 meters to approximately 150 meters. The maximum stresses in the pavement cross section occur in the joint area and they determine the dimensions, bedding indexes and reinforcements. In this respect, long and short slabs differ but little. The added expense for prestressing must be recovered from the savings in the construction and maintenance of the joints. As soon as the joints are eliminated altogether, however, substantial savings are effected in the subbase, due to the reduction of the bedding index and additional noticeable savings are made in the pavement itself, due to reductions in thickness and reinforcements. It is the purpose of the invention to apply a known prestressing system, the so-called "internal" prestressing method, and to construct pavements in such a way that joints are eliminated.

The present invention applies the "internal" prestressing as described in my U.S. Pat. No. 3,516,211, to construct pavements of any desired length, without joints. These pavements are to be poured by a finisher, so that they lie on a plane subbase and have a constant thickness.

Two methods were described in my earlier applications. In method A, the invention applied the "internal" prestress in such a way that the slab constructed last was always prestressed by means of the peripheral members of the "internal" prestress tendons, thus shortening the slab. In a second step, the core members were used to further prestress and thus shorten the last slab further. Method A was the object of the application Ser. No. 712,469, now abandoned, and the German laid-open patent application DT-P 25 37 616.

In method B, the slabs were made in a first step by a finisher, a working gap was left between the slabs of the pavement for placing jacks. This working gap was closed in a second step and prestressed. This method was the object of the German laid-open patent application DT-P 26 38 457.

SUMMARY OF THE INVENTION

It is an object of the present invention to provide an improved method for constructing a pavement, made up from a plurality of slabs, joined by construction joints, wherein the slabs are internally prestressed by the use of novel prestressing elements.

It is a further object of the present invention to provide an apparatus for the prestressing of concrete slabs using the novel prestressing elements as part of the prestressing apparatus.

It is another object of the present invention to provide an improved method for constructing a pavement, made from a plurality of slabs, wherein prestressing is performed from slab to slab, as the construction proceeds.

The features and objects of the present invention will become more apparent from the following description and drawings, showing diagrammatically certain embodiments of the invention, wherein:

FIG. 1 is a cross-sectional view through an internal prestressing tendon, the ribs being omitted on the peripheral members and core member;

FIG. 2*a* is a cross-sectional view, along line a—a of 2*b*, of an internal prestressing tendon in the area of a compression anchor, or latch;

FIGS. 2*b* and 2*c* are longitudinal sectional views of an internal prestressing tendon with the compression anchor in respective released and locked positions, ribs and concrete being omitted from these sections;

FIG. 2*d* is a longitudinal sectional view of the internal prestressing tendon, with the ribs of a core member cold-worked into the engaging piece;

FIG. 3*a* is a cross-sectional view along line b—b, of FIG. 3*b*, rotated 90° counter-clockwise, and FIG. 3*b* is a plan view of the "internal" prestressing tendon taken in the area of the tension anchor, or latch;

Figure 7:
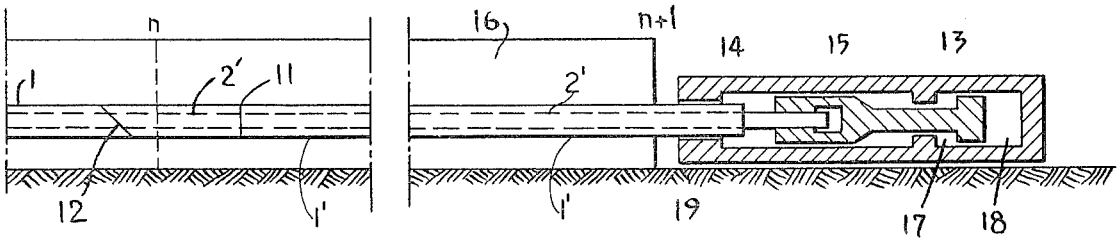
Figure 8A:
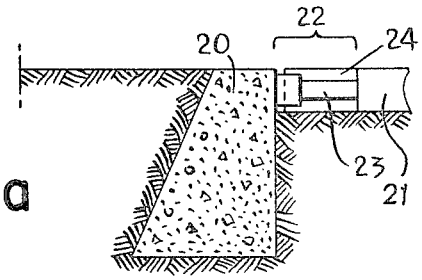
Figure 8B:
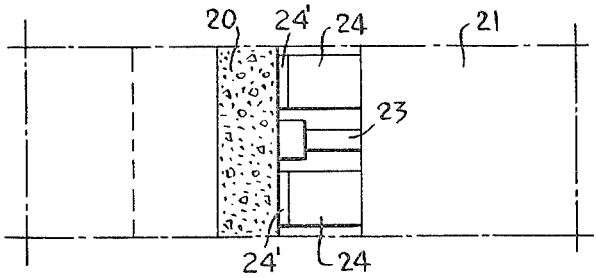
Figure 6A:
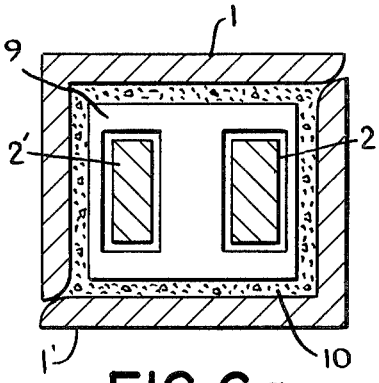
Figure 6B:
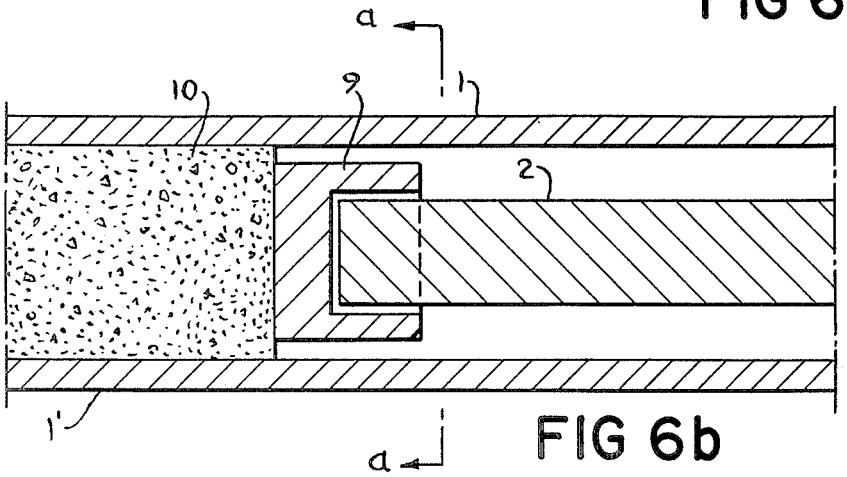

FIG. 6*a* is a cross-sectional view through an internal prestressing tendon, along line a—a of FIG. 6*b;* and FIG. 6*b* is a longitudinal sectional view of an internal prestressing tendon, in a mold, distributing pressure to a mortar stop;

FIG. 7 is a longitudinal sectional view illustrating the construction of a pavement slab in accordance with this invention;

FIG. 8*a* is a longitudinal sectional view through the end of a slab, including a fixed abutment, and a jack;

FIG. 8*b* is a plan view of the same slab as in 8*a;*

Figure 9:
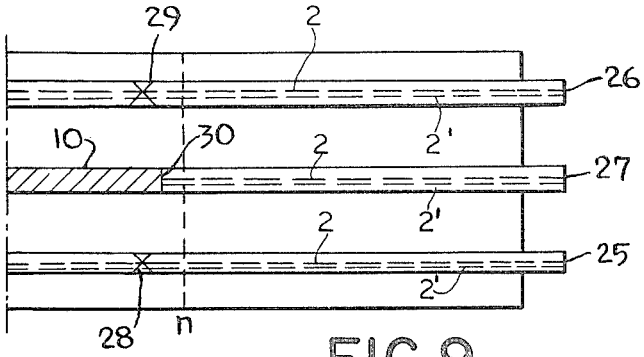
Figure 10:
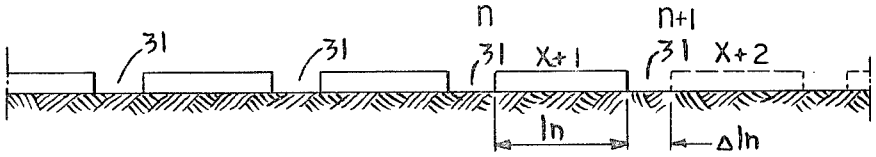
Figure 11:
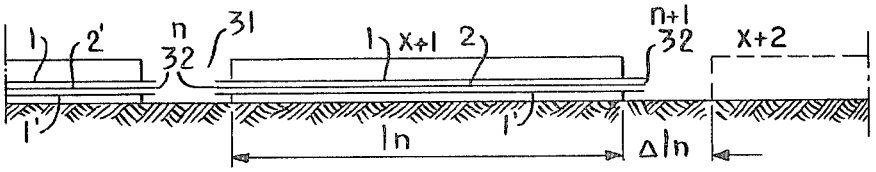
Figure 12:
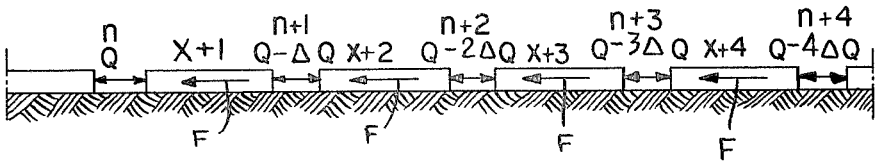
Figure 13:
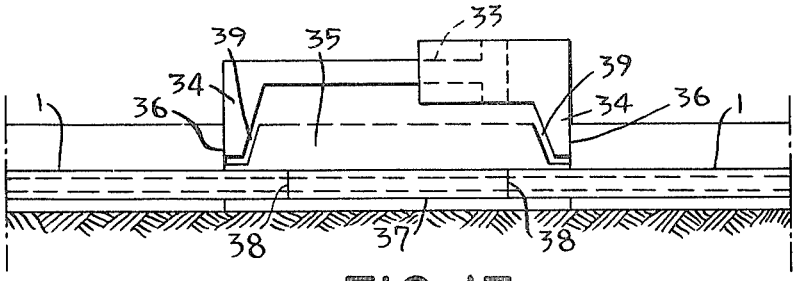
Figure 14:
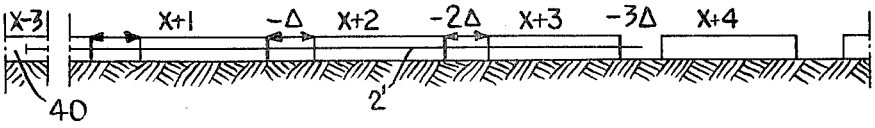

FIG. 9 is a plan view of a slab, including pressure anchors;

FIG. 10 is a longitudinal sectional view of slabs constructed in accordance with this invention;

FIG. 11 is a longitudinal sectional view of slabs in accordance with this invention, including the peripheral members and core member exposed in the open gaps between the slab;

FIG. 12 is a longitudinal sectional view with open working gaps, with the forces acting near the working gap, shown as vectors;

FIG. 13 is a longitudinal sectional view of the closing of a gap, in accordance with the present invention; and FIG. 14 is a longitudinal sectional view of an alternative method for closing the working gap, in accordance with the present invention.

DESCRIPTION OF THE PREFERRED EMBODIMENTS

Figure 1:
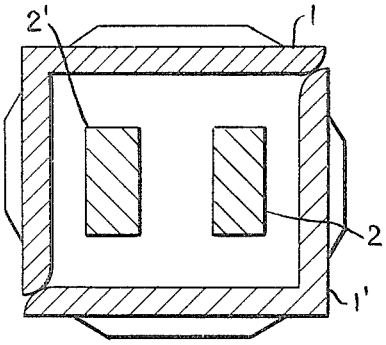
Figure 2D:
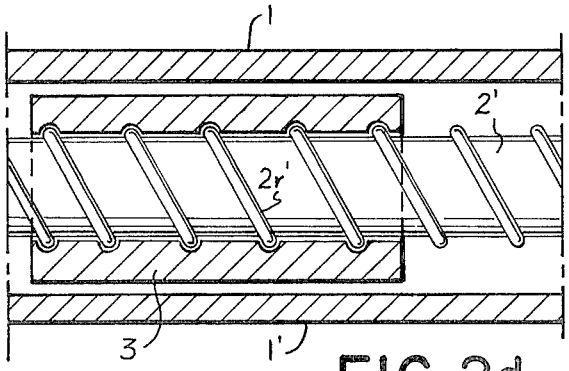
Figure 2B:
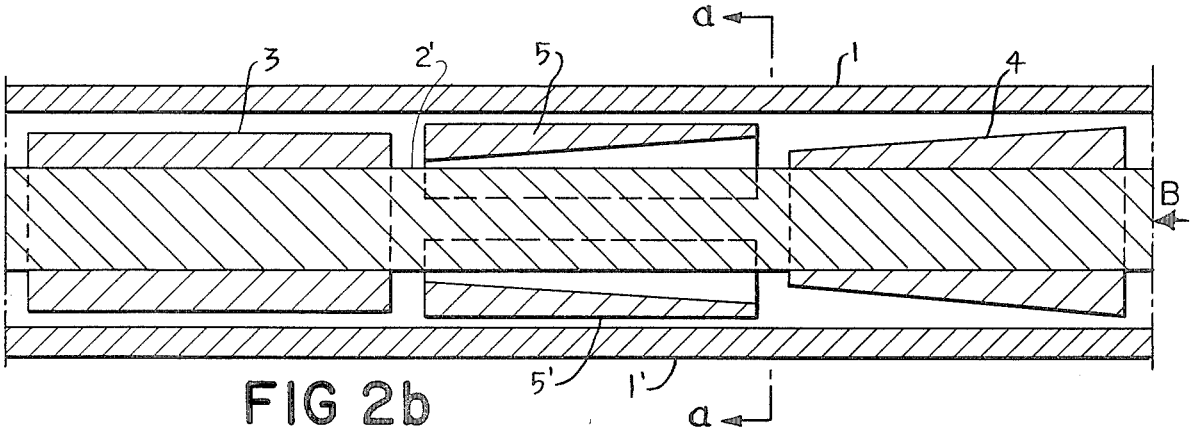

Referring now to the drawings, FIG. 1 shows peripheral members 1, 1', which consist of commercially available angle irons having unequal legs. Peripheral members other than the ones shown may also be used. The peripheral members are required to be easily rollable and should be suitable for allowing a hollow space to be defined between peripheral members. For example, 1, and 1' are placed together to define a hollow space therebetween. Steel of any desired quality can be used, and the quality need not be as high as customarily employed for prestressing steels, because creeping, which shortens the bars, does not occur. The bars for the peripheral members 1, 1', may have any desired length, for instance, up to 150 m; bars longer than 22 m are preferably shipped in rolls. The core members 2, 2' consist of two "Neptune" wires of the type N 120, in quality 125/140, or the like. These core members are furnished in rolls of 300 m length and have ribs 2'r, as shown in FIG. 2*d*. Here too, core members other than the ones shown, could possibly be used.

Figure 2C:
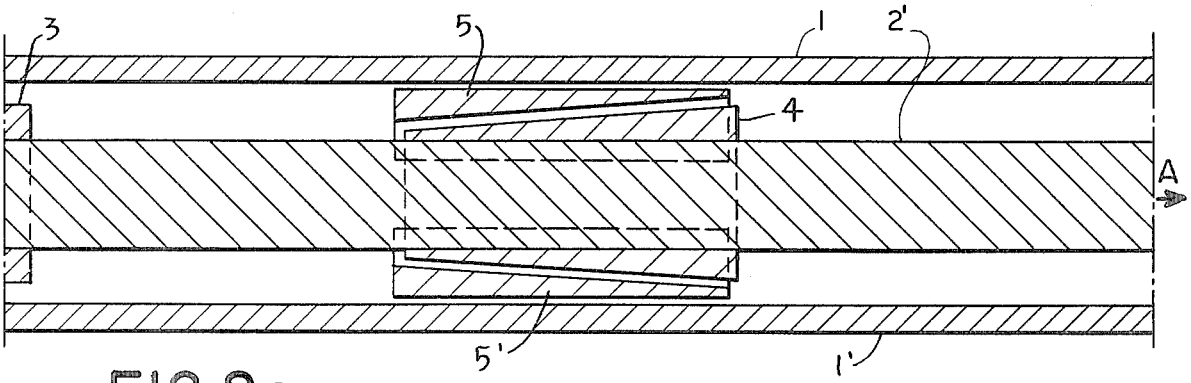
Figure 2A:
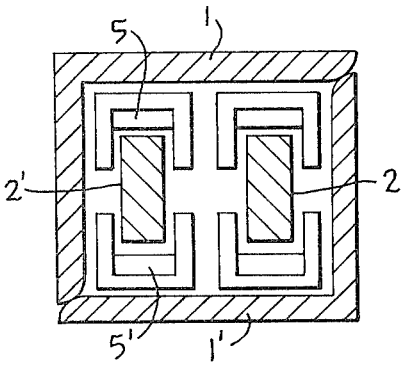

As can be seen from FIGS. 2*a,b,c*, and 3*a,b*, mounted on the core members are both compression and tension latches or anchors, each latch consisting of wedges. These wedges enable core members 2,2' to latch in either a state of compression or tension, and to be released from both states. The core members 2,2', when released from both tension and compression, can slide easily in the hollow chamber formed by the peripheral members 1,1'.

Figure 4:
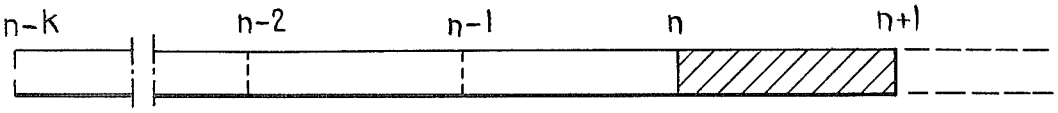
FIG. 4 is a plan view of a pavement strip, constructed in accordance with this invention.

In order to generate the "internal" prestress, a compression wedge assembly is provided on core members 2, and 2', at a suitable distance from the end, which approximately corresponds to the casting length for a pavement slab of 150 m (Cf. FIG. 4). This compression wedge assembly is capable of latching core members 2, and 2', in a state of compression, as shown in FIG. 2*c*. Engaging pieces 3, and fixed wedges 4, are pressed on the core members 2,2' with such pressure that the material is cold-worked into the ribs of the core members 2,2'. Loose wedges 5 are placed between engaging pieces 3, and the fixed wedges 4. FIG. 2(*b*) shows the relative positions of engaging pieces 3, fixed wedges 4, and loose wedges 5, in the released position.

FIG. 2*c* shows the relative positions of the engaging piece 3, fixed wedge 4 and loose wedge 5 in the locked position. The released position, shown in FIG. 2*b*, occurs when the core member 2, with fixed wedge 4 attached, is pulled in the direction of the arrow A, as shown in FIG. 2*c*, relative to the loose wedge 5. FIG. 2*d* shows the ribs 2'r on core member 2' cold-worked into the engaging piece 3.

Figure 3A:
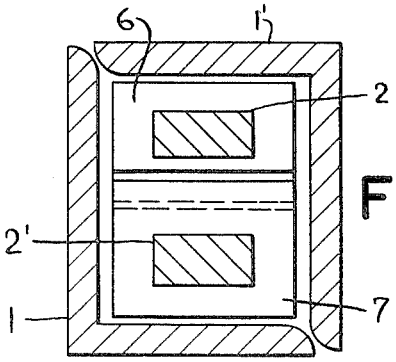
Figure 3B:
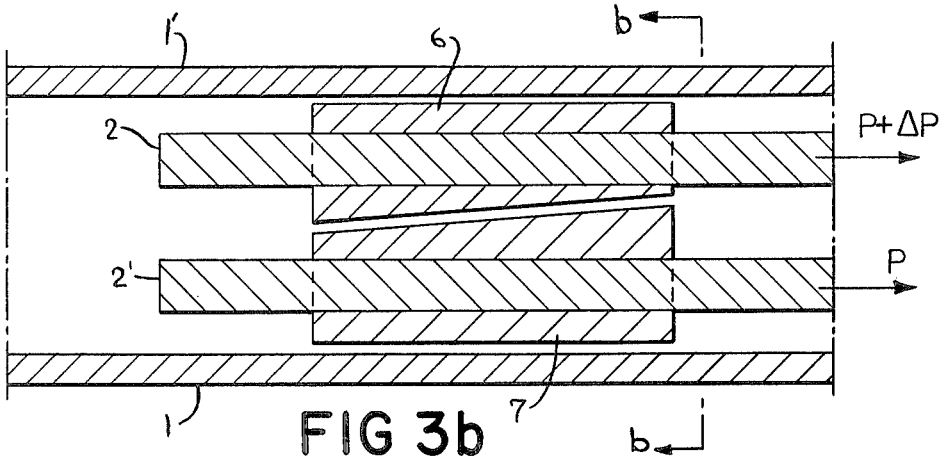

The core members 2,2', according to FIG. 3*b*, may also be latched in tension; this is done by means of wedges located near the ends of the core members. The ends of the core member 2,2' can be positioned in earlier constructed slabs. The core members 2,2' are locked in tension when the pulling force ($P+\Delta P$) exerted on one core member 2, in the direction of arrow B, exceeds by $\Delta P$, the force (P) exerted on the other core member 2', with $\Delta P$ having a magnitude sufficiently large to cause wedges 6 and 7 (FIG. 3*b*) to grip one another. In order to release the tension latch, the core member 2 need only be pressed by an incremental force $\Delta P$ in relation to the peripheral member 2'.

FIG. 4 illustrates sections of pavements made according to the first method of the present invention. Sections between the joints n to n-k are completed, while the section between joints n and n+1, having a length of about 150 m, is to be constructed.

FIG. 7 illustrates the first step of prestressing the slab between joint n and n+1. The peripheral members 1, 1' protrude over the joint n. The peripheral members 1, 1' are extended by means of welding an additional length of steel onto the peripheral elements at 11. (This weld is shown in further detail in FIG. 5 at 8). The core members 2,2' have a wedge arrangement capable of being locked in compression at 12.

The core members 2, 2' and the peripheral members 1, 1' extend beyond the joint n+1 (FIG. 7). A jack 13, shown diagrammatically, comprises two chambers 17 and 18, and feet 19, and is operable in tension and compression. The jack 13 engages the peripheral members 1, and 1' at 14, and the core members 2, and 2', at 15. The jack pulls the peripheral members 1, 1', thereby putting then into tension, while at the same time, the jack pushes core members 2, 2', putting them into compression when the wedges lock at 12. As a result, the internal prestressing of the tendon is brought about.

After this prestressing, an anchoring—not shown—can replace the jack by fixing the tensioned peripheral members 1, and 1' against the compressed core members 2, and 2'. The concrete 16 is then poured; in most cases, this is done with finisher equipment. As the concrete hardens, the anchoring is released by means of a thread method not shown in the drawings. When the anchoring is released, the newly constructed slab becomes displaced against the joint n and the slab is put in a state of prestress.

In the second step, the ends of the core members 2, and 2', are positioned in a slab lying to the left of the newly constructed slab. The positioning can be accomplished by disengaging the wedges and sliding the core members through the hollow space formed by the peripheral members until the tension wedges, located near the ends of the core members 2, 2', are in the desired slab.

The core members 2, and 2' have both compression and tension wedges mounted on them. The slab between the tension anchor and the free end n+1, are post-tensioned against the friction between the sub-base and pavement by means of pulling on core members 2, and 2', which are thereby put into tension when the wedges 6, 7, shown in FIG. 3*b* lock.

When the next slab is built, this post-tension must be released, so only an amount of stress remains, which results from the aforementioned friction. This stress has its greatest value near the tension anchor and decreases in the direction of the joint n+1.

Figure 5:
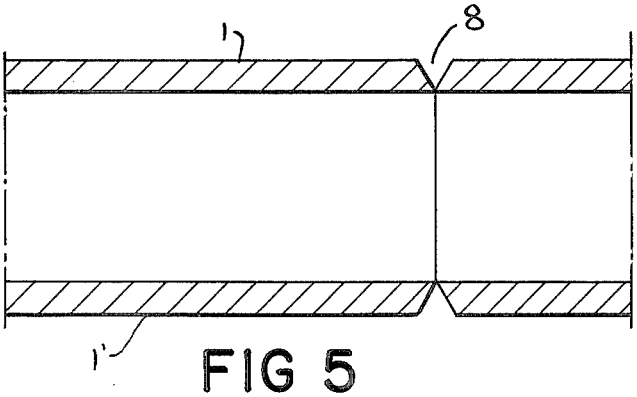
FIG. 5 is a longitudinal sectional view showing the details of a weld interconnecting the peripheral members of two tendons.

When the peripheral members 1, and 1' are extended as shown in FIG. 7, at 11, and in FIG. 5, at 8, this procedure presupposes that the peripheral members 1, and 1', are weldable steel. High-grade steels are missing this weldable property, so in their use, it is necessary to make the joint in a different manner. The peripheral members may still be supplied in a rolled up fashion.

In the slabs not at the ends of the pavement, after core members 2, and 2' are used for post-tensioning, they are removed from the newly constructed slab and the only reinforcement remaining upon completion of constructions consists of peripheral members 1, and 1'. After removal of core members 2, and 2', the hollow space inside these peripheral members 1, and 1' may be filled with grout.

In the end section, the core members 2, and 2' are left after construction. The core members are not fixed to the peripheral members 1, and 1', so that any pretension lost in the end section through creeping, can be restored by post-tensioning the core members 2, 2', employing the tension connection explained in connection with FIGS. 3*a,b*. If necessary, prestressing of the end section can be increased in a known manner at the end of the pavement by performing the prestressing against an abutment 20, as shown in FIGS. 8*a,b*. Between the fixed abutment 20, and the pavement 21, there is a working gap 22. Jack 23 pushes the slab 21, as it is resting against the abutment 20. After prestressing slab 21, the displacement is fixed by pouring the concrete strip 24, this strip being supplied with a mortar joint 24', for small displacements.

Due to the frequent changes in temperature, the increased prestress applied to the end sections will move into the center section with time and will restore, in the center section, the prestress lost through creeping.

In a modification of the first construction method, it is possible to coordinate the grouting operation with the progress of construction in such a manner that the compression anchor, shown in FIG. 2, is replaced by the grouting mortar, as shown shown in FIG. 6, which provides direct support for core members 2,2'. A mold portion 9 distributes the pressure applied to core members 2, and 2', to the mortar 10.

Often, it is desirable to combine the rear tension anchor of FIG. 13, with a compression anchor as shown in FIG. 6. This arrangement is partly shown in FIG. 9. Tendons 25, and 26 have pressure and tension anchors (the tension anchors are not shown), as in FIGS. 2 and 3, respectively. The tendon 27 uses the mortar 10, as a compression anchor or stop, the mortar 10 is hosed in from the open end on the right, and placed in the rear part of the tendon, similar to FIG. 6.

The pressure anchors are positioned in tendon 25, at 28, and in tendon 26, at 29.

The first method provides for a pavement to be built step-by-step, with stopping at every joint, because the last slab must be set and prestressed. This stopping is avoided by the second method.

The second method provides for the construction of slabs of pavement in a first step by finisher equipment. The working gaps 31 are spaced as shown in FIG. 10. Each of these gaps have a length $\Delta$ 1n which is adequate for the operation of a jack. The slabs are "internally" prestressed at both ends, as shown for one end in FIG. 7. The slabs are post-tensioned in a known art, as shown schematically, and anchored at 32 in FIG. 11.

The core members 2, and 2' are without engagement with the peripheral members 1, and 1', and further post-tensioning can replace the stress lost by creeping. The slabs are prestressed "internally" at an early stage of hardening. When the amount of prestress is very low, it may be useful to cut dummy joints to avoid jagged cracks.

The slabs can lie any length of time with open gaps 31. Often, it is convenient to close the gaps at a low temperature when the slab is shortened to a minimum. This state can be brought about artificially by cooled air or water. When the rear gap 31 is to be closed, jacks are placed in the gaps with forces distributed, as shown in FIG. 12. The force Q can be of any amount, if enough joints are filled with jacks having a force $Q-m\ \Delta\ Q$, $(m=1\ldots K)$ at $n+1$ to $n+k$ with $\Delta$ Q being smaller than the force F, of the friction between subbase and pavement. So, the slabs are shortened without becoming displaced as a whole. A set of jacks can build up any amount of prestress in the pavement.

FIG. 13 details the closing of the gap 31. The jack 33 has feet 34, which abuts the concrete 35. Small mold-frame 36 prevent bond of the feet 34 with the concrete 35. When the jacks 33 exert the forces Q to $Q\times m\ \Delta\ Q$, in each of the appropriate gaps, the core members 2 and 2' of the slab $x+1$ shown in FIG. 12, are released and removed. The peripheral members 1 and 1' are welded by joints 38 to a fitting piece 37. This weld is shown in further detail in FIG. 5 at 8.

The concrete 35 is poured. After its hardening, the rear jack is released, and concrete 35 becomes stressed by an amount which is given off by the neighboring slabs. The molds are removed, and the hollow space 39 grouted. The rear jack is brought to $n+k+1$, and all forces in the jacks are increased with $\Delta$ Q.

Producing a pavement according to this second method requires the following steps. The subbase is graded, the "internal" prestress tendons are positioned. Peripheral members 1,1' are placed in tension, core members, 2 and 2' are placed in compression, and both the peripheral and core members are anchored. The gaps between the slabs are shuttered off, the finisher places the concrete. While concrete sets, the "internal" prestress is released, then the core members are post-tensioned. The jacks are placed in the gaps 31 with forces distributed as indicated in FIG. 12. The core members 2,2' are removed in the last slab. The last gap to the left is poured and closed. After the concrete hardens, the rear jack is released. The molds are removed, the hollow space 39 is grouted. The rear jack is brought to the most forward gap, $n+k+1$, and all forces in the jacks are increased by $\Delta$ Q.

Fewer jacks are needed by modifying the method in accordance with FIG. 14. This is done by using long core members 2,2' to substitute for some of the jacks. The peripheral members are extended with fitting pieces 37, as shown in FIG. 13. The core members of the individual slabs are removed and replaced by long core members having a length of at least $w(1n+\Delta\ 1n)$, where w represents the number of slabs between the tension latch and the jack at the free end. The tension latch is placed in the rear slab as shown in FIG. 14, at 40, where the anchoring takes place in slab $x-3$. After tensioning, the long core members are released and pulled to the right to be positioned in another slab, for example, slab $x+4$. Here also the last open gap to the left is closed at each step.

I wish it to be understood that I do not desire to be limited to the exact details of construction shown and described, for obvious modification will occur to a person skilled in the art.

Having thus described the invention, what I claim as new and desire to be secured by Letters Patent, is as follows:

1. An apparatus for prestressing concrete, comprising in combination, a tendon comprising at lease one elongated tensionable peripheral member defining an enclosure structure open at least at one end, and at least two elongated core members disposed in said enclosure structure;

first latching means including a part mounted on at least one of said core members and being capable of latching said core member relative to said peripheral member when a compressive force is applied to said core member, whereby, when a compressive force latches said core member relative to said peripheral member, said peripheral member is put into a state of tension, the concrete is placed on said tendon, and upon release of said tensile and compressive forces, said concrete will be prestressed:

second latching means mounted on at least two of said core members capable of latching said core members relative to said peripheral member, in a state of tension, when differential tensile force is applied to said core members; whereby after the concrete has set, the concrete will be post-tensioned;

said first and second latching means being slidable along with said core members within said peripheral member when unlatched.

2. An apparatus as claimed in claim 1, wherein said first latching means comprises, in combination:

a longitudinal loose wedge disposed within said peripheral member and having two ends;

a fixed wedge mounted on at least one of said core members and disposed near one of said loose wedge, said fixed wedge interlocking with said loose wedge when said core member is pushed in one direction, and said fixed wedge unlocking from said loose wedge when said core member is pulled in the opposite direction; and an engaging piece secured to said core member and disposed near the other end of said loose wedge for pushing said loose wedge when said core member is pulled in said opposite direction, whereby said first latching means may be slidably moved inside said peripheral member when said fixed wedge is unlocked from said loose wedge.

3. An apparatus as claimed in claim 1, wherein said second latching means comprises, in combination:

a first wedge secured to a first of said elongated core members, a second wedge secured to a second of said elongated core members, said second wedge engaging slidingly said first wedge, causing said first and second wedges to exert pressure transversely of the direction of elongation against the internal surface of said peripheral member and thus interlocking the wedges and the core members and the peripheral member when said first core member is moved in a certain longitudinal direction and the second core member is moved in the opposite longitudinal direction, though inferiorly, said first and second wedges disengaging upon return movement of either core member.

4. In a method for constructing prestressed concrete slabs, utilizing longitudinal tendons having two ends and comprising at least one longitudinal peripheral member which defines a hollow space containing at least two longitudinal core members and force generating means for applying tension and compression to said members, the steps comprising, (a) placing at least one tendon on a subbase;

(b) attaching said force generating means to at least one end of said tendon, so as to engage said peripheral member and at lease one core member;

(c) pulling with said force generating means on said peripheral member;

(d) pushing with said force generating means at least one of said core members;

(e) simultaneously releasably latching said core member to said peripheral member;

(f) thereby maintaining said core member in a state of compression and said peripheral member in a state of tension;

(g) thereafter pouring concrete so as to form a concrete slab;

(h) subsequently, after the concrete has set, releasing said pulling and pushing force application, thereby prestressing the concrete slab;

(i) thereafter pulling on at least one of said core members;

(j) simultaneously releasably latching said core members to said peripheral member, so as to maintain said core members in a state of tension, thereby post-tensioning the concrete slab;

(k) thereafter releasing said pulling force application;

(l) extending said peripheral member by affixing an additional length to the end of the peripheral member;

(m) sliding said core member within said interconnected peripheral members, so as to position said first and second latching means for the exertion of compression and tension; and (n) repeating steps (b) through (m), until a desired length of slabs is constructed.

5. The method as claimed in claim 4, wherein the last slab constructed is the end section concrete slab and the steps further comprise:

pushing the end section concrete slab with a jack placed between a fixed abutment and said end section slab; and pouring a concrete strip between said end section concrete and said abutment, whereby said end section is further prestressed.

6. The method as claimed in claim 4, wherein said slabs include an end slab and said core member is removed from all slabs except said end slab, the steps further comprising post-tensioning said end slab by pulling on said core member.

7. The method as claimed in claim 6, wherein the steps further comprise:

grouting the empty hollow space defined by said peripheral members, said empty hollow space being formed when said core members are removed from said peripheral member.

8. The method as claimed in claim 4, wherein said core members are releasably latched to said peripheral members in an earlier constructed slab.

9. A prestressed concrete pavement comprising in combination:

a plurality of prestressed concrete intermediate slabs and two prestressed concrete end slabs, at least one gap being defined between adjoining slabs, concrete being disposed and prestressed in said gap;

each of said slabs having at least one peripheral member, the peripheral member of each slab defining an enclosure structure, and being aligned with, and connected to, a corresponding peripheral member of a neighboring slab, each peripheral member of said intermediate slabs being grout-filled, the peripheral member of at least one of said end slabs includes at least one tensionable core member, whereby said end slab may be post-tensioned by said core member.

10. A prestressed concrete pavement as claimed in claim 9, wherein one of the prestressed concrete intermediate slabs adjoining said end slab includes said tensionable core member, whereby said end slab and the concrete intermediate slab adjoining said end slab may be post-tensioned by said core member.

11. In a method for constructing a concrete pavement including a plurality of adjoining prestressed concrete slabs sequentially arranged, including a first slab and a last slab, each concrete slab being spaced apart from an adjoining slab by a gap adequate for the positioning and operation of a jack, there being a plurality of sequential gaps including a first gap and a last gap, wherein each slab contains at least one tendon, said tendon of each slab being substantially aligned with the tendon of the adjoining slab, said tendon including at least one elongated tensionable peripheral member defining an enclosure structure open at least at one end and at least two tensionable elongated core members disposed in said enclosure structure, the steps comprising:

(a) inserting a jack into sequential gaps, including at least the first of said sequential gaps;

(b) pushing with said jack against corresponding adjoining slabs so as to put said slabs in a state of compression;

(c) removing said core members from the first concrete slab;

(d) interconnecting the peripheral members of the slabs adjoining said first gap;

(e) placing concrete in said first gap;

(f) removing the jack present in the first in the sequence of said sequential gaps thereby prestressing the concrete in said first gap;

(g) placing the removed jack in the next sequentially available gap;

(h) adjusting each of said jacks in said gaps so as to exert a pushing force on said slabs adequate for compressing said slabs without displacing said slab;

(i) removing the core members from the concrete slab sequential to said concrete-filled gap;

(j) interconnecting the peripheral members of the slabs adjoining the gap sequential to said concrete-filled gap;

(k) placing concrete in said sequential gap;

(l) removing the jack from said successive gap thereby prestressing the concrete in said gap;

(m) repeating steps g–l until all remaining sequential gaps are filled with jacks;

(n) repeating steps h–l until one jack remains in the last gap;

(o) adjust said jack in said last gap so as to exert a pushing force on said adjoining slabs adequate for compressing said adjoining slabs without displacing them;

(p) interconnecting the peripheral members of the slabs adjoining said last gap;

(q) placing concrete in said last gap; and (r) post-tensioning said last concrete slab by pulling on said tensionable core members present in said last slab.

12. The method as claimed in claim 11, further comprising the step of removing the core members from the last slab.

13. The method as claimed in claim 12, further comprising the step of grouting at least a portion of the enclosure structure of said interconnected peripheral members.

14. The method as claimed in claim 12, further comprising the step of inserting a tensionable longitudinal core member through the interconnected peripheral members of at least some sequentially arranged slabs and post-tensioning said slabs by pulling on said longitudinal core members.

* * * * *